United States Patent [19]

Coffey

[11] 4,268,936

[45] May 26, 1981

[54] APPARATUS FOR CHOPPING STRANDS

[75] Inventor: Fred S. Coffey, Newark, Ohio

[73] Assignee: Owens-Corning Fiberglas Corporation, Toledo, Ohio

[21] Appl. No.: 65,690

[22] Filed: Aug. 10, 1979

[51] Int. Cl.[3] ..... D01G 1/04

[52] U.S. Cl. ..... 19/0.56; 15/104.04; 19/0.6

[58] Field of Search ..... 19/0.3–0.64; 15/104.04; 83/913

[56] References Cited

U.S. PATENT DOCUMENTS

| | | | |
|---|---|---|---|
| 1,898,727 | 2/1933 | Hoppes | 15/104.04 |
| 2,014,947 | 9/1935 | McCulloch et al. | 19/0.46 X |
| 2,384,032 | 9/1945 | Jackson | 19/0.56 |
| 2,890,862 | 6/1959 | Heller | 15/104.04 X |
| 3,128,507 | 4/1964 | Pearson | 19/0.41 |

*Primary Examiner*—Louis Rimrodt

*Attorney, Agent, or Firm*—Ronald C. Hudgens; Philip R. Cloutier; Greg Dziegielewski

[57] ABSTRACT

A squirrel cage type long strand eliminator is provided intermediate the chopper and the collection region to eliminate undesirably long sections of strand from free falling discrete segments of strand as they are being formed from a continuous strand.

6 Claims, 4 Drawing Figures

APPARATUS FOR CHOPPING STRANDS

TECHNICAL FIELD

This invention relates to apparatus for removing undesirable lengths of strand from the desired discrete lengths of strands as the discrete lengths are being formed from continuous strands.

BACKGROUND ART

Relatively short chopped fibrous glass strands are frequently shipped in cartons for further processing in the manufacture of other products. Equipment designed to handle such chopped strands can be disrupted when relatively longer strand segments enter the system.

The undesirable longer sections of strand can be formed due to any one of a number of reasons such as the chopper is out of adjustment and/or the cutting blades are worn.

Previously, visual inspection of the contents of the carton was relied upon to detect the presence of undesirably long strands. Without continuous inspection, some long strands were inadvertently packaged. This invention provides continuous elimination of such undesirable lengths of strand from the desired segments as they are formed.

DISCLOSURE OF THE INVENTION

Apparatus is provided wherein a driven rotatable squirrel cage type wheel or roll is located intermediate the chopper and the collection region or chute for the discrete segments of strand.

BEST MODE OF CARRYING OUT THE INVENTION

Figure 2:
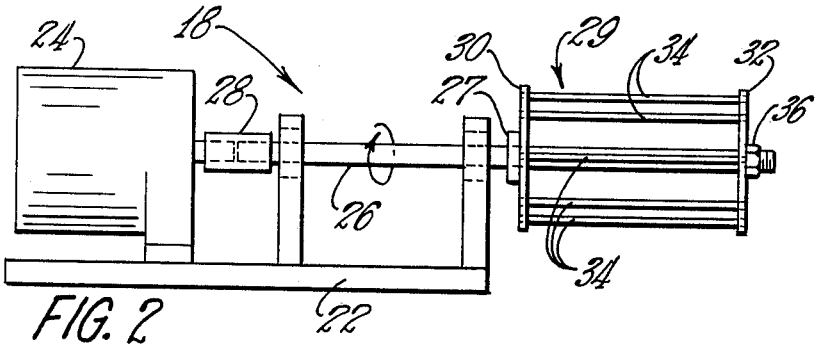
FIG. 2 is a front elevational view of one embodiment of the squirrel cage type long strand eliminator.
Figure 1:
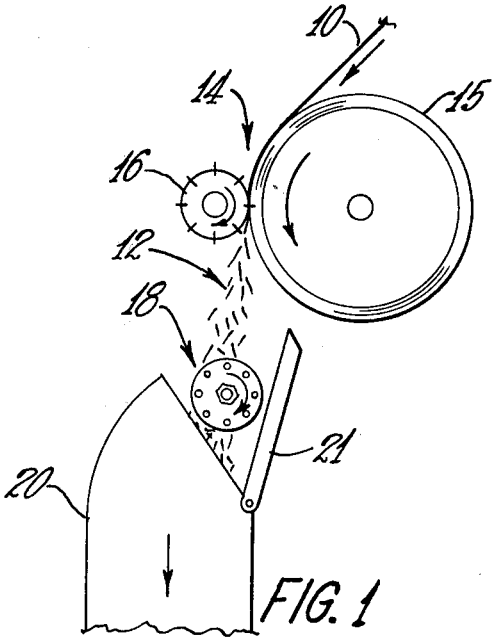
FIG. 1 is a front elevational view of the long strand eliminator assembly in conjunction with the cutting means and collection chute.

As shown in FIGS. 1 and 2, strand 10, which can be comprised of a plurality of continuous glass filaments, is chopped or severed into discrete segments 12 by means of chopper or means for severing 14, as is known in the art. Chopper 14 is comprised of back-up roll 15 and cutter roll 16.

Ultimately, the discrete segments 12 fall into collection chute or recepticle 20 which has a door or member 21 associated therewith for covering the opening of chute 20 at predetermined times.

Long strand eliminator assembly 18 is located intermediate chopper 14 and collection chute or region 20 in the path of the falling discrete segments 12.

Generally, the discrete segments have a desired length within the range from about ¼ inch to about 2½ inches long.

Basically, the long strand eliminator is a squirrel cage type wheel that is rotated in the path of the discrete segments to collect the undesirably long strand sections upon the members comprising the outer cylindrical periphery of the squirrel cage. The axis of rotation of the cage is generally transverse or preferably perpendicular to the general path of advancement of the discrete segments 12 between the chopper 14 and chute 20.

As shown in FIG. 2, long strand eliminator 18 is comprised of a base 22 having motor 24 securely mounted thereto and shaft 26 suitably journaled therein. Shaft 26 is suitably fastened to motor 24 by means of coupling 28. Squirrel cage 29 is comprised of first plate 30, second plate 32 and a plurality of rods or members 34 extending therebetween. Squirrel cage 29 is securely mounted on shaft 26 such that first plate 30 butts against shoulder 27 of shaft 26. Rods 34 are securely fastened to first and second plates 30 and 32 such that as nut 36 is drawn down on a threaded section of shaft 26 the cage assembly is immovably fastened to shaft 26.

Rods 34 can be fastened to plates 30 and 32 by any conventional means, such as welding and/or press fitting. Also, plates 30 and 32 can be keyed to shaft 26 to prevent the rotation of the squirrel cage 29 with respect to shaft 26. In practice, for the aforementioned lengths of strand, eight ¼ inch diameter rods are located on a 3 inch diameter base circle, and the cage is rotated at a speed from about 100 to about 500 rpm to collect the undesirably long sections of strand having a length of approximately 6 inches or more on cage 29.

Since the cage is rotating during operation, there is a tendency for some of the discrete segments 12 to be thrown radially outward therefrom. Therefore, the long strand eliminator assembly 18 is positioned within the "V" formed by the opening in chute 20 and door 21 to collect the horizontally projected segments 12.

During operation, the long strand eliminator as shown in FIG. 2 can be cleaned by a blast of air and the like.

Figure 3:
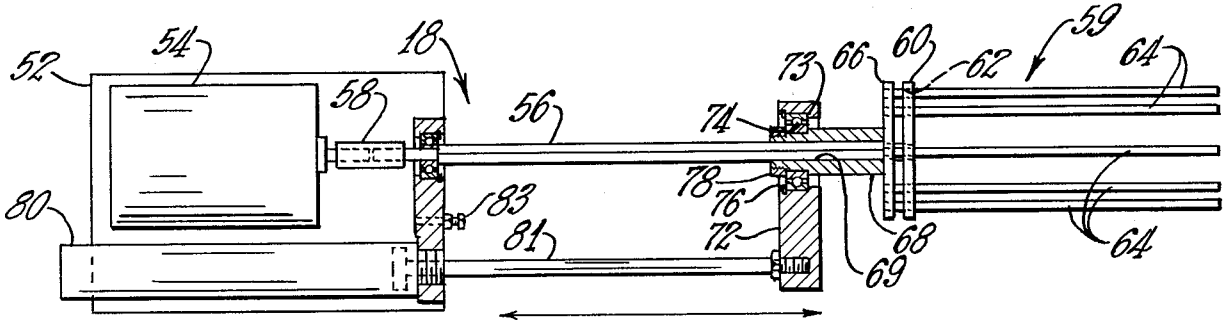
FIG. 3 is a plan view of another embodiment of a squirrel cage type long strand eliminator.
Figure 4:
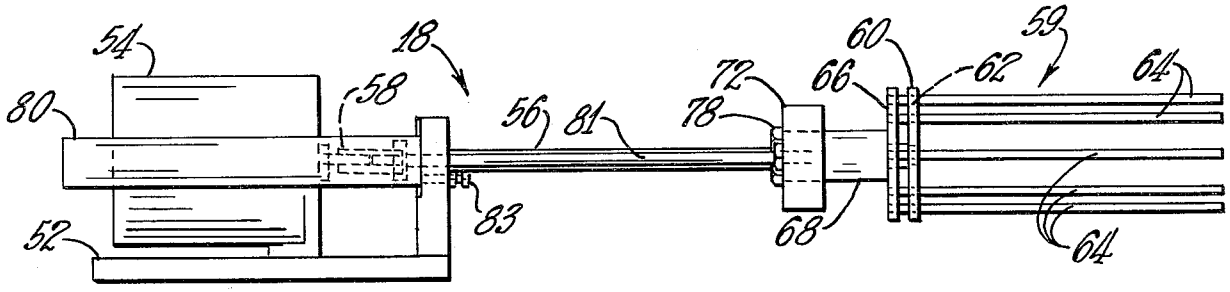
FIG. 4 is a elevational view of the long strand eliminator shown in FIG. 3.

As shown in FIGS. 3 and 4, long strand eliminator assembly 18 is designed to be for self-cleaning. As such, long strand eliminator 18 is comprised of a base 52, a drive means or motor 54, and a retractable rotatable squirrel cage 59. Motor 54 is securely fastened to base 52, and drive shaft 56 is suitably attached to motor 54 by means of coupling 58. Shaft 56 is suitably journaled in base 52.

First disk or member 60 is rigidly fastened to the digital end of shaft 56. The first disk 60 has a plurality of apertures 62 located along the periphery thereof to slideably receive rods 64 extending along the axis of rotation of shaft 56.

Rods 64 are rigidly fastened to second disk or member 66 which is rigidly fastened to sleeve 68. Sleeve 68 is adapted to slideably engage shaft 56 along the length thereof and yet be rotatably driven by the rotation of shaft 56, by any suitable means. For example, a portion of the length shaft 56 is hexagonal in shape with passageway 69 of sleeve 68 also being hexagonal in shape to receive shaft 56 and be rotatably driven therewith.

During operation, as the undesirably long sections of strand collect upon rods 64, the rods can be purged from such sections of strands by moving second disk 66 and sleeve 68 along the length of shaft 56 such that the rods 64 are withdrawn through apertures 62 such that the rods 64 are wiped clean by first disk 60. Then, the second disk 66 is moved in the opposite direction to reinsert the rods 64 into the path of the falling discrete segments 12.

Second disk 66 can be moved along the length of drive shaft 56 by any suitable means. As shown in FIGS. 3 and 4, sleeve 68 is suitably journaled in connection element 72. As such, bearing 74 is located in seat 73 of element 72 and retained therein by means of retainer means or retaining ring 76. The inner race of bearing 74 is suitably fastened to sleeve 68 by means of shoulder and nut arrangement 78.

Connection element 72 is reciprocably moved along shaft 56 by motive means or pneumatic cylinder 80 which is suitably fastened to base 52. The distal end of piston rod 81 of air cylinder 80 is securely fastened to element 72. The retraction of element 72 and rods 64 is positively located by means of stop 83 attached to base 52. For adjustment, stop 83 can be comprised of a threaded bolt and locknut system associated with base 52 such that element 72 contacts the head of the bolt to provide positive positioning to prevent the rods 64 from being totally withdrawn from the first disk.

Air cylinder 80 is connected to a suitable supply of pressurized air and controlled by a conventional valve (not shown) by the operator. With the long strand eliminator 18 as shown in FIGS. 3 and 4, door 21 can be suitably electro-mechanically interconnected to cover the opening in chute 20 such that the discrete segments of strand 12 are generally not permitted to enter chute 20 when the rods 64 are withdrawn from the path of the falling segments 12.

The long strand eliminator assembly should be positioned such that first disk 60 is positioned outside the collection zone such that the long strands that fall from the rods during the self-cleaning cycle do not fall into the collection region 20.

For eliminating undesirably long sections of strand from chopped or discrete segments that have a desired length from about ½ to about 2 ½ inches, eight ¼ inch diameter rods are equally spaced apart on a 3 inch diameter base circle, and the cage 59 should be rotated at a speed from about 100 to about 500 rpm. Thus, undesirably long strands will be wound in and about rods 64 during operation.

As shown in FIGS. 3 and 4, rods 64 are substantially parallel with respect to each other and to the axis of rotation thereof. Similarly, the rods 34 shown in FIG. 2 are substantially parallel to each other and to the axis of rotation thereof. However, rods 34 may be skewed with respect to the axis of rotation and to each other, since the rods are not moved through the apertures of another plate.

It is apparent that within the scope of the invention, modifications and different arrangements can be made other than as herein disclosed. The present disclosure is merely illustrative with the invention comprehending all variations thereof.

I claim:

1. Apparatus for removing undesirably long sections of strand from advancing discrete segments of strand comprising:

means for forming said discrete segments of strand;

drive means for rotating a shaft;

a first member rigidly fastened at the distal end of said shaft, said member having a plurality of apertures adapted to slidably receive a plurality of after-defined rods adapted to collect said undesirably long sections of strand thereon;

a second member adapted to move along the length of said shaft; and a plurality of rods rigidly fastened to said second member such that as said second member is moved along the length of said shaft, said rods are moved through said first member such that said undesirable sections of strand attached to said rods are removed therefrom.

2. The apparatus of claim 1 further comprising a sleeve adapted for sliding engagement along the length of said shaft, said sleeve being adapted to receive said shaft to be rotated therewith such that said first member and said second member are driven in unison.

3. Apparatus for collecting undesirably long sections of strand from discrete segments of strand advancing along a path comprising:

drive means for rotating a shaft, said shaft having an axis of rotation substantially transverse the path of the advancing segments;

a first member rigidly fastened at the distal end of said shaft, said member having a plurality of apertures to slideably receive a plurality of after-defined rods adapted to collect said undesirably long sections of strand thereon while permitting said discrete segments to pass therethrough as said shaft is rotated;

a second member adapted to slideably engage said shaft;

a plurality of rods rigidly fastened to said second member, said rods being oriented substantially parallel to said shaft such that as said second member is moved along the length of said shaft said rods are moved through the apertures of said first member to remove the undesirably long sections of strand from said rods at a predetermined time.

4. The apparatus of claim 3 wherein said second member has a sleeve associated therewith, said sleeve being adapted to slideably engage said shaft such that said sleeve and second member are rotated in unison with said rods.

5. The apparatus of claim 4 wherein at least a portion of said shaft has a non-cylindrical cross-section shape and said sleeve has a passageway adapted to substantially conform to said cross-sectional shape.

6. The apparatus of claim 5 further comprising a motive means adapted to move a connection element along the length of said shaft, said sleeve being journaled in said connection element.

* * * * *

UNITED STATES PATENT AND TRADEMARK OFFICE

CERTIFICATE OF CORRECTION

PATENT NO. : 4,268,936
DATED : May 26, 1981
INVENTOR(S) : Fred S. Coffey

It is certified that error appears in the above—identified patent and that said Letters Patent is hereby corrected as shown below:

At column 2, line 36, the word "for" should be deleted.

At column 2, line 44, the word "digital" should be changed to "distal".

Signed and Sealed this

*Twenty-eighth* Day of *July 1981*

[SEAL]

*Attest:*

GERALD J. MOSSINGHOFF

*Attesting Officer*

*Commissioner of Patents and Trademarks*